US007247130B2

(12) United States Patent
Mattila et al.

(10) Patent No.: US 7,247,130 B2
(45) Date of Patent: Jul. 24, 2007

(54) METHOD OF FORMING COMPOSITE INFORMATIONAL ITEM

(76) Inventors: Roger B. Mattila, 913 Stonebridge Way, Woodridge, IL (US) 60517; William C. Neubauer, 126 Mainsail Dr., Grayslake, IL (US) 60030

( * ) Notice: Subject to any disclaimer, the term of this patent is extended or adjusted under 35 U.S.C. 154(b) by 0 days.

(21) Appl. No.: 11/238,299

(22) Filed: Sep. 29, 2005

(65) Prior Publication Data

US 2006/0030468 A1 Feb. 9, 2006

Related U.S. Application Data

(63) Continuation of application No. 10/418,875, filed on Apr. 18, 2003, now abandoned.

(51) Int. Cl.
*B31F 1/00* (2006.01)

(52) U.S. Cl. ..... 493/421; 493/405; 493/408; 493/419; 493/444; 493/379; 493/393

(58) Field of Classification Search ..... 493/405, 493/408, 419, 421, 442, 443, 444, 374, 379, 493/393, 394; 270/52.02, 52.13
See application file for complete search history.

(56) References Cited

U.S. PATENT DOCUMENTS

| | | | | |
|---|---|---|---|---|
| 3,937,458 | A | 2/1976 | Langen | 271/95 |
| 4,616,815 | A | 10/1986 | Vijuk | 270/45 |
| 4,643,633 | A | 2/1987 | Lashyro | 414/732 |
| 4,812,195 | A | 3/1989 | Vijuk | 156/357 |
| 4,817,931 | A | 4/1989 | Vijuk | 270/37 |
| 4,905,977 | A | 3/1990 | Vijuk | 270/45 |
| 5,021,273 | A | 6/1991 | Kobayashi | 281/2 |
| 5,044,873 | A | 9/1991 | Vijuk | 414/792.5 |
| 5,046,710 | A | 9/1991 | Vijuk | 270/37 |
| 5,105,931 | A | 4/1992 | Lashyro | 198/471.1 |
| 5,276,628 | A | 1/1994 | Schneiderhan | 271/259 |
| 5,458,374 | A | 10/1995 | Vijuk et al. | 283/81 |
| 5,554,094 | A | 9/1996 | Veins | 493/421 |
| 5,667,210 | A | 9/1997 | DeLise, Jr. | 493/436 |

(Continued)

OTHER PUBLICATIONS

Office action from corresponding Canadian application No. 2,444,751 dated May 26, 2006.

*Primary Examiner*—Louis Huynh
(74) *Attorney, Agent, or Firm*—Marshall, Gerstein & Borun LLP

(57) ABSTRACT

A method of forming a composite informational item having information regarding a pharmaceutical product printed thereon from a first informational item, such as a bidirectionally folded outsert or a booklet, and a second informational item, such as a bidirectionally folded outsert or a booklet, may comprise (a) forming the first informational item; (b) automatically conveying the first informational item from a location in a first feed apparatus to a bonding location; (c) providing a plurality of the second informational items in a second feed apparatus different than the first feed apparatus; (d) automatically depositing a releasable adhesive on a face of one of the informational items; (e) automatically conveying one of the second informational items from a location in the second feed apparatus to the bonding location; and (f) causing a face of the first informational item to make contact with a face of the second informational item so that the first informational item and the one second informational item are releasably bonded together via the releasable adhesive applied to the face of one of the informational items.

11 Claims, 15 Drawing Sheets

U.S. PATENT DOCUMENTS 5,685,530 A 11/1997 DeLise ..... 281/2
5,791,689 A 8/1998 Dovel ..... 281/5
5,813,700 A 9/1998 Vijuk et al. ..... 283/81
5,830,550 A 11/1998 Treleaven et al. ..... 281/2
5,863,628 A 1/1999 Barry ..... 281/2
5,876,029 A 3/1999 Wright et al. ..... 271/3.18
5,909,899 A 6/1999 Vijuk et al. ..... 283/81
5,945,195 A 8/1999 McDonald ..... 428/121
6,024,825 A 2/2000 Dovel et al. ..... 281/5
6,068,300 A 5/2000 Vijuk et al. ..... 283/67
6,095,512 A 8/2000 Vijuk et al. ..... 271/3.05
6,158,778 A 12/2000 Vijuk et al. ..... 283/67
6,257,568 B1 7/2001 Vijuk et al. ..... 271/3.05
6,273,411 B1 8/2001 Vijuk ..... 270/37
6,349,973 B1 2/2002 Vijuk et al. ..... 283/67
6,406,581 B1 6/2002 Furst et al. ..... 493/405
6,506,275 B1 1/2003 Vijuk et al. ..... 156/227

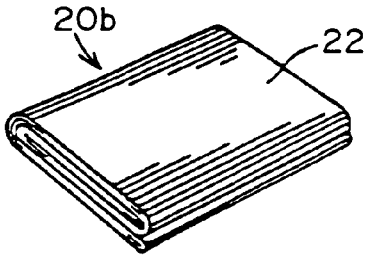
FIG. 3
FIG. 3A
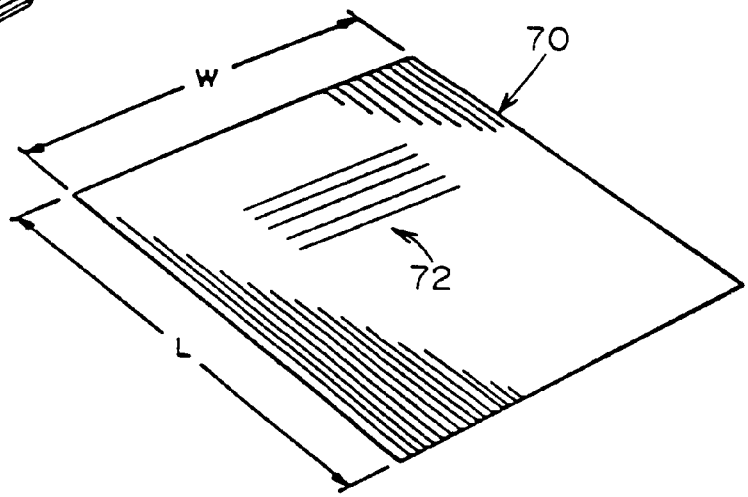
FIG. 3B
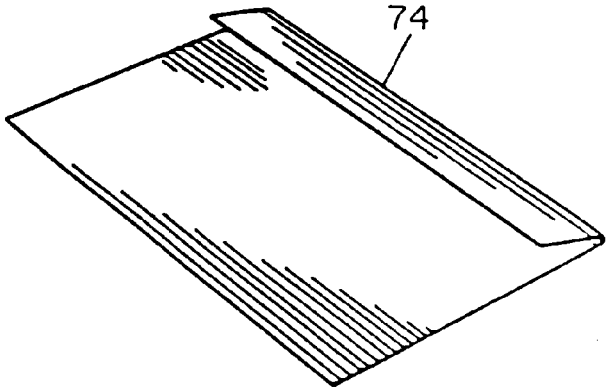
FIG. 3C
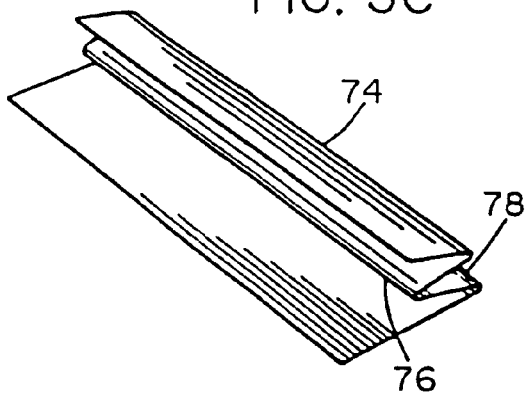
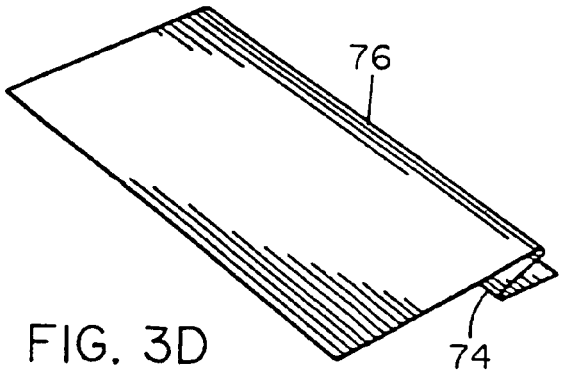
FIG. 3D
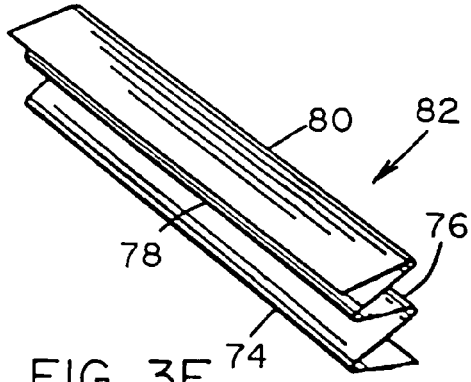
FIG. 3E

METHOD OF FORMING COMPOSITE INFORMATIONAL ITEM

This is a continuation of U.S. Ser. No. 10/418,875 filed in the Patent Office on Apr. 18, 2003, now abandoned, which is incorporated by reference herein in its entirety.

BACKGROUND

The present invention is directed to a method of bonding together at least two informational items carrying distinct sets or types of information to form a composite informational item.

The government requires informational items to be included with many pharmaceutical products. The informational items are typically provided as a printed product, such as a folded outsert, a folded insert, a booklet, or a label.

An outsert is an informational item formed from a sheet of paper which is folded in two perpendicular directions. The sheet of paper has information printed thereon, which is typically information relating to a pharmaceutical product or drug. The outsert may be adhesively attached to the top or side of a pharmaceutical container, such as a bottle of pills. Alternatively, the outsert may be inserted loosely into a cardboard box in which a pharmaceutical container is disposed. After purchase of the pharmaceutical product by a consumer, the outsert may be unfolded so that the consumer may read the information printed thereon.

A booklet is similar to an outsert in that a sheet of paper having information printed thereon is folded in two perpendicular directions. Prior to folding, however, adhesive is deposited along a centerline of the sheet so that, after folding in a first direction, central portions of each sheet panel are adhered together. When the sheet is folded in the perpendicular direction, the adhered sheet portions form a spine of the booklet. Side edges of the folded booklet are removed so that the sheet panels form individual pages of the booklet that are secured only at the spine. The booklet may be further folded to resemble a conventional outsert.

There are a number of patents which disclose methods of and machines for forming outserts and booklets. For example, U.S. Pat. No. 4,616,815 to Michael Vijuk discloses an automatic stacking and folding apparatus. U.S. Pat. No. 4,812,195 to Michael Vijuk discloses various methods and apparatus for forming outserts. U.S. Pat. No. 4,817,931 to Robert Vijuk discloses a method and apparatus for forming a folded leaflet. U.S. Pat. No. 5,044,873 to Michael Vijuk discloses an apparatus for stacking folded sheets on edge. U.S. Pat. Nos. 5,458,374, 5,813,700 and 5,909,899 disclose various methods of forming outserts. Commonly owned U.S. Pat. No. 6,273,411 discloses various methods and apparatus for forming booklets.

Many products require two or more distinct informational items to be provided with the product. For example, a first informational item may be directed to the pharmacist and/or physician, while a second informational item may be directed to the patient. The information provided in the first and second informational items may be quite different. Consequently, pharmaceutical suppliers must take steps to ensure that each type of informational item is provided with the product.

Furthermore, recent federal regulations mandate that pharmaceutical suppliers electronically verify each informational item before it is applied to a pharmaceutical product. Because each informational item is typically produced by a designated folding machine, pharmaceutical suppliers employ manual labor to transfer the items from the folding machine to an assembly area, where the items may be grouped together for a given product. Manually handling of the informational items significantly increases the possibility of human error, which may complicate the task of electronically verifying each informational item before application to the product.

U.S. Pat. No. 5,791,689 discloses a multiple leaflet literature assembly having a first leaflet detachably secured to an assembly of leaflets including a plurality of integrally formed second leaflets. The first leaflet has a first identifier while the assembly of leaflets has a second identifier. Because the second leaflets of the assembly of leaflets are integrally formed and detachably secured to one another, the second identifier is used to identify all of the second leaflets.

SUMMARY OF THE INVENTION

The invention is directed to a method of forming a composite informational item having information regarding a pharmaceutical product printed thereon from a first informational item, such as a bidirectionally folded outsert or a booklet, and a second informational item, such as a bidirectionally folded outsert or a booklet. The method comprises (a) forming the first informational item; (b) automatically conveying the first informational item from a location in a first feed apparatus to a bonding location; (c) providing a plurality of the second informational items in a second feed apparatus different than the first feed apparatus; (d) automatically depositing a releasable adhesive on a face of one of the informational items; (e) automatically conveying one of the second informational items from a location in the second feed apparatus to the bonding location; and (f) causing a face of the first informational item to make contact with a face of the second informational item so that the first informational item and the one second informational item are releasably bonded together via the releasable adhesive applied to the face of one of the informational items.

The features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 3 is a perspective view of another embodiment of an informational item that may be included in the composite informational item of FIG. 1;

FIGS. 3A–3I illustrate the manner in which the informational item of FIG. 3 is formed;

DETAILED DESCRIPTION OF VARIOUS EMBODIMENTS

Figure 1A:
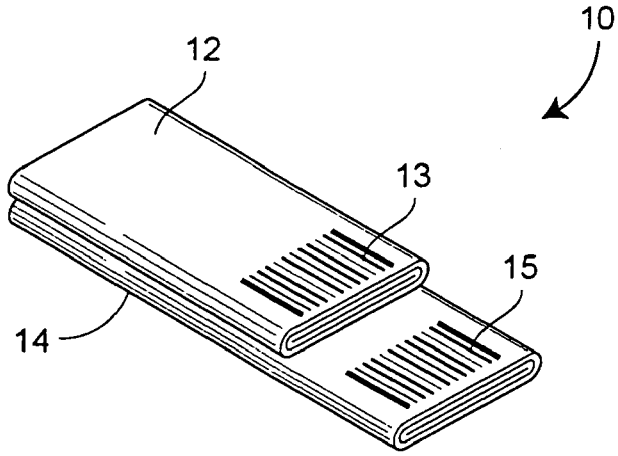
FIG. 1A is a top perspective view of a composite informational item.
Figure 1B:
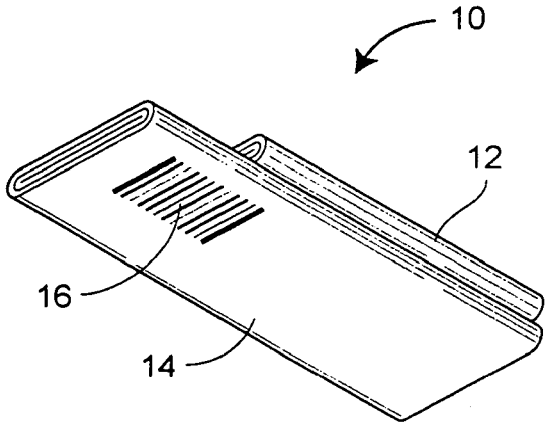
FIG. 1B is a bottom perspective view of a composite informational item showing an alternative location for an electronically readable identifier.

FIGS. 1A and 1B are a top perspective view and a bottom perspective view, respectively, of two embodiments of a composite informational item 10. In each embodiment, the composite informational item 10 includes a first informational item 12 releasably secured, such as by an adhesive, to a second informational item 14. Each of the first and second informational items 12, 14 has detailed information printed thereon, which printed information typically relates to one or more pharmaceutical products or drugs.

The first and second informational items 12, 14 may contain different sets of information. For example the first informational item 12 may provide information for a pharmacist and/or physician, while the second informational item 14 may provide information for a patient. Alternatively, the first and second informational items 12, 14 may provide the same set of information, but in different languages. For example, the first informational item 12 may provide patient information in a primary language, such as English, while the second informational item 14 provides patient information in one or more secondary languages, such as French, Spanish, German, etc.

The first and second informational items 12, 14 may be further provided with respective electronically readable identifiers 13, 15, such as bar codes, to automate verification of the informational items 12, 14 prior to insertion into a box or carton containing a pharmaceutical product. The identifiers 13, 15 may be coded to correspond to records in an electronic database which automatically identifies the informational items 12, 14. In the embodiment illustrated in FIG. 1A, the informational items 12, 14 are sized and the identifiers 13, 15 are positioned so that both identifiers 13, 15 are readable from a single side of the composite informational item 10. The second informational item 14 may further include a second or alternative identifier 16 readable from an opposite side of the composite informational item 10, as shown in FIG. 1B.

The first and second informational items 12, 14 may be bonded together via an adhesive disposed between adjacent faces of the informational items. The adhesive may be releasable to allow a doctor or patient to remove the appropriate informational item from the other as needed. As used herein, the word "adhesive" is intended to encompass cold, adhesive, hot-melt adhesive, tape, or any other material that is used to adhere or bond surfaces together. The adhesive may be selected so as to allow easy removal of one of the first and second informational items 12, 14 from the composite informational item 10 without tearing or otherwise damaging the removed informational item or the remaining informational items. One adhesive that may be used is a cold glue adhesive, GMS Part No. GLUE-23704, which is commercially available from Graphic Machinery & Systems of San Rafael, Calif. That adhesive is also marketed by its manufacturer as Capitol Latex Adhesive L179.

While, in the embodiment of FIGS. 1A and 1B, the first and second informational items 12, 14 are provided as outserts, each of the first and second informational items 12, 14 may be provided in different forms, such as a booklet, label, or other substrate for carrying information. As used herein, the term "outsert" generally means an informational item which is folded from a sheet of paper and which can be later unfolded to read information printed on the sheet of paper. As used herein, the term "booklet" generally means an informational item having a plurality of pages which are bonded or otherwise connected together along one edge. A booklet may be an unfolded booklet or a folded booklet, as described below.

Figure 1C:
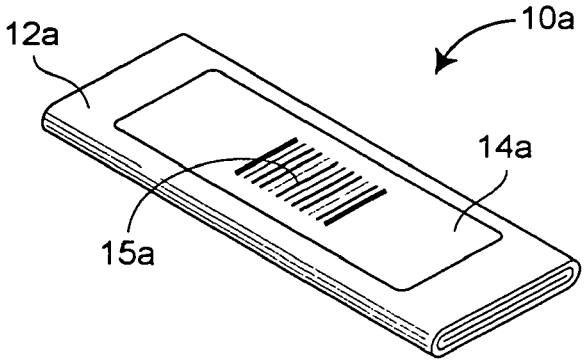
FIG. 1C is a top perspective view of an alternative composite informational item.

FIG. 1C is a top perspective view of an alternative embodiment of a composite informational item 10*a*. The composite informational item 10*a* includes a first informational item 12*a* in the form of an outsert and a second informational item 14*a* in the form of a label. The first and second informational items 12*a*, 14*a* are releasably adhered together as described above in connection with the embodiment of FIGS. 1A and 1B. The second informational item 14*a* includes an electronically readable identifier 15*a*, such as a bar code.

Methods of Forming Outserts

Figure 2:
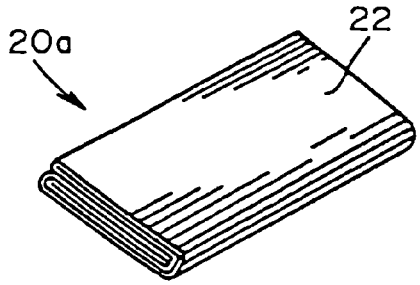
FIG. 2 is a perspective view of one embodiment of an informational item that may be included in the composite informational item of FIG. 1.

FIG. 2 is a perspective view of an outsert 20*a* which may form the first or second informational item included as part of the composite informational item 10/10*a* of FIGS. 1A–1D, and FIGS. 2A–2E illustrate a method of forming the outsert 20*a*.

Figure 2A:
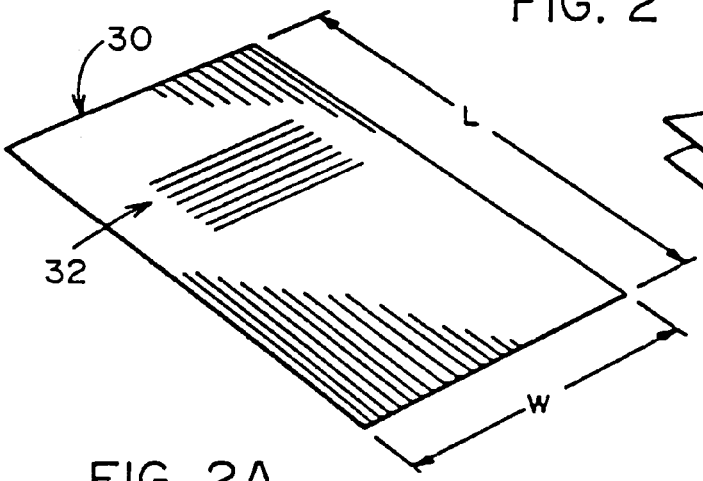
FIGS. 2A–2E illustrate the manner in which the informational item of FIG. 2 is formed.
Figure 2B:
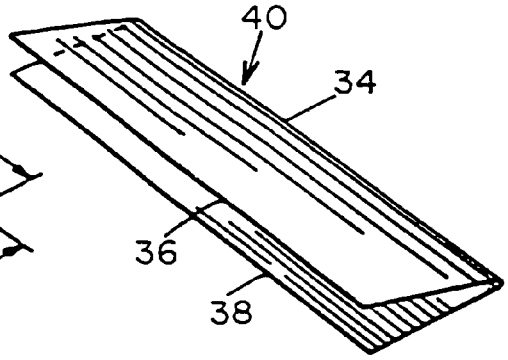

Referring to FIG. 2A, the outsert 20*a* may be formed from a sheet 30 of paper having information 32 printed thereon. The sheet 30 has a length L and a width W. Referring to FIG. 2B, the sheet 30 may be folded in a direction parallel to its length, such as by folding the sheet 30 in half, so that the sheet has a fold or folded edge 34 that is parallel to its length and a pair of unfolded edges 36, 38 parallel to its length. One or more additional folds (not shown) may be made in a direction parallel to the length of the sheet 30. As a result of making such fold(s) in the direction parallel to the length of the sheet 30, a folded article 40 having a length and a width is formed.

Figure 2C:
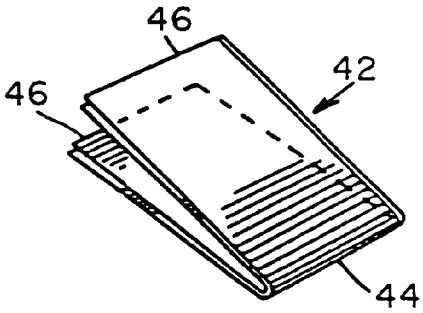

Referring to FIG. 2C, the folded article 40 shown in FIG. 2B is then folded in a direction parallel to the width of the folded article 40 and perpendicular to its length to form a folded article 42 having a first end that is composed of a fold or folded edge 44 and a second end composed of a plurality of unfolded sheet edges 46.

Figure 2D:
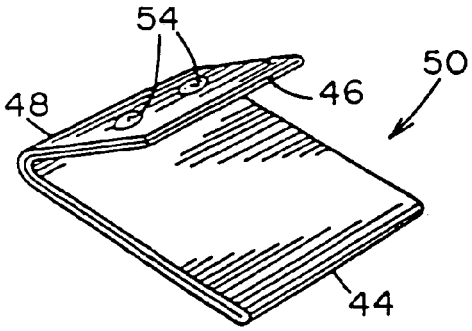

Referring to FIG. 2D, the folded article 42 shown in FIG. 2C is then folded again by making a fold 48 in the same direction as the fold 44 made in FIG. 2C to form a folded article 50. The folded article 50 has a first end that is composed of the folded edge 44 and a second end composed of the fold or folded edge 48. The fold 48 of FIG. 2D is made so that the unfolded sheet edges 46 are disposed between the two folded edges 44, 48. One or more drops 54 of adhesive may be applied to a sheet portion of the folded article 50.

Figure 2E:
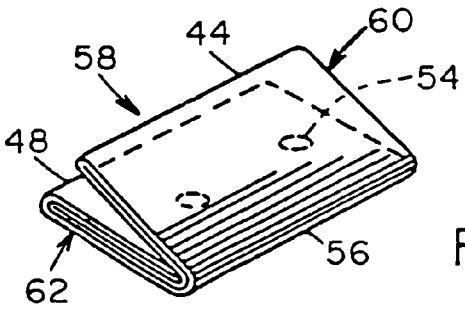

Referring to FIG. 2E, the folded article 50 shown in FIG. 2D is then folded again by making a fold 56 in the same direction to form a folded article 58, with the unfolded sheet edges 46 being enclosed within the folded article 58. The fold 56 may be made at a point along the folded article 50 so that the folded edges 44, 48 are disposed directly adjacent each other. The folded article 58 has an upper portion 60 composed of a plurality of sheet thicknesses and a lower portion 62 composed of a plurality of sheet thicknesses. When the upper portion 60 makes contact with the adhesive 54 disposed on the lower portion 62, the adhesive 54 bonds the upper and lower portions 60, 62 together to form the substantially closed outsert 20*a* shown in FIG. 2 having no exterior unfolded sheet edges that lie in a direction parallel to the fold 56.

FIG. 3 is a perspective view of an outsert 20*b* which may form the first or second informational item included as part of the composite informational item 10/10*a* of FIGS. 1A–1D, and FIGS. 3A–3I illustrate a method of forming the outsert 20*b*.

Referring to FIG. 3A, the outsert 20*b* may be formed from a sheet 70 of paper having information 72 printed thereon. The sheet 70 has a length L and a width W. Referring to FIGS. 3B–3E, a plurality of folds 74, 76, 78, 80 may be made in the sheet 70 in a direction parallel to its length to form a folded article 82 shown in FIG. 3E having a length and a width. Although the folds 74, 76, 78, 80 are shown to be alternating or accordion-type folds, the folds could be made in other ways, such as by successively folding the sheet 70 in half.

Figure 3F:
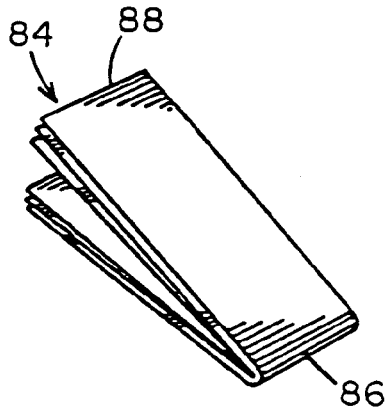

Referring to FIG. 3F, the folded article 82 shown in FIG. 3E is then folded in a direction parallel to the width of the folded article 82 and perpendicular to its length to form a folded article 84 having a first end that is composed of a fold or folded edge 86 and a second end composed of a plurality of unfolded sheet edges 88.

Figure 3G:
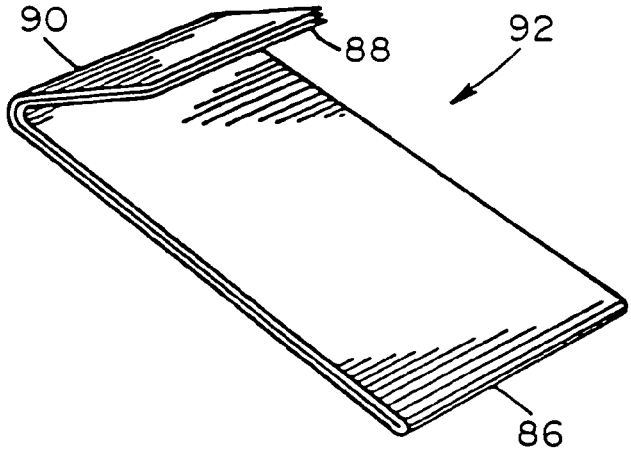

Referring to FIG. 3G, the folded article 84 shown in FIG. 3F is then folded again by making a fold 90 in the same direction as the fold 86 made in FIG. 3F to form a folded article 92. The folded article 92 has a first end that is composed of the folded edge 86 and a second end composed of the fold or folded edge 90. The fold 90 of FIG. 3G is made so that the unfolded sheet edges 88 are disposed between two folded edges 86, 90.

Figure 3H:
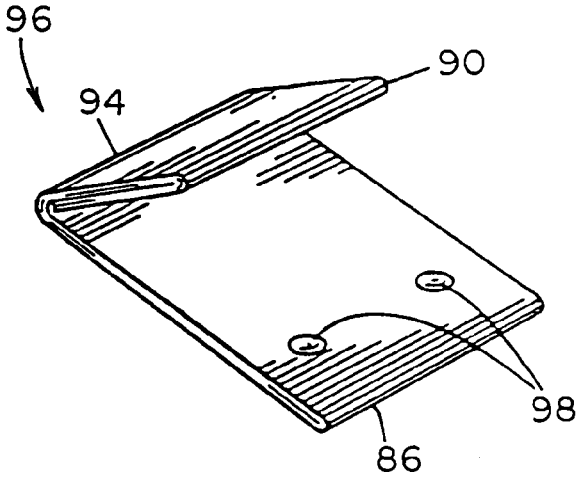

Referring to FIG. 3H, the folded article 92 shown in FIG. 3G is then folded again by making a fold 94 in a direction parallel to the fold 90 to form a folded article 96, the fold 94 being made so that the fold 90 is disposed between the fold 86 and the fold 94. One or more drops of adhesive 98 may be applied to the folded article 96.

Figure 3I:
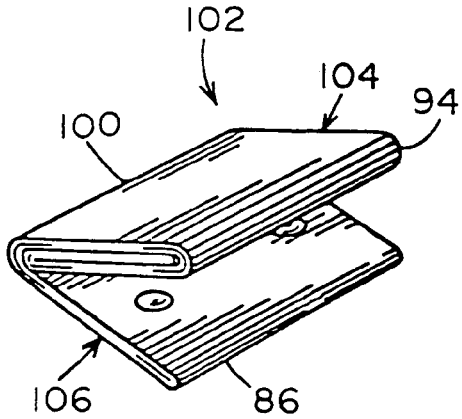

Referring to FIG. 3I, the folded article 96 shown in FIG. 3H is then folded again by making a fold 100 in the same direction to form a folded article 102. The fold 100 may be made at a point along the folded article 96 so that the folded edges 86, 94 are disposed directly adjacent each other. The folded article 102 has an upper portion 104 composed of a plurality of sheet thicknesses and a lower portion 106 composed of a plurality of sheet thicknesses. When the upper portion 104 makes contact with the adhesive 98 disposed on the lower portion 106, the adhesive 98 bonds the upper and lower portions 104, 106 together to form the substantially closed outsert 20*b* shown in FIG. 3 having no exterior unfolded sheet edges that lie in a direction parallel to the fold 100.

While two methods of forming outserts are described above, it should be understood that other methods of forming outserts could be utilized, such as those disclosed in U.S. Pat. No. 4,817,931 to Vijuk and U.S. Pat. No. 5,813,700 to Vijuk, et al., which are incorporated by reference herein.

Methods of Forming Booklets

Figure 4A:
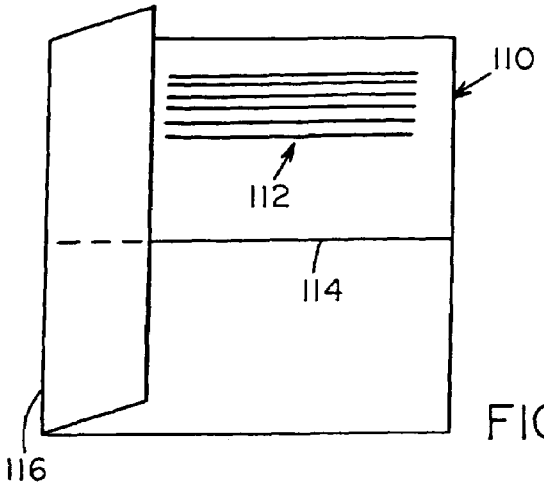
FIGS. 4A–4H illustrate a manner of forming several additional informational item embodiments that may be included in the composite informational item of FIG. 1.

FIGS. 4A–4F illustrate a method of forming a booklet 20*c* (FIG. 4F) which may form the first or second informational items included as part of the composite informational item 10/10*a* of FIGS. 1A–1D. Referring to FIG. 4A, the booklet 20*c* may be formed from a sheet of paper 110 having information 112 printed thereon. A portion of an adhesive 114 is applied across the sheet 110 in a generally linear direction, and then a fold 116 is made in the sheet 110 in a direction perpendicular to the adhesive 114.

Figure 4D:
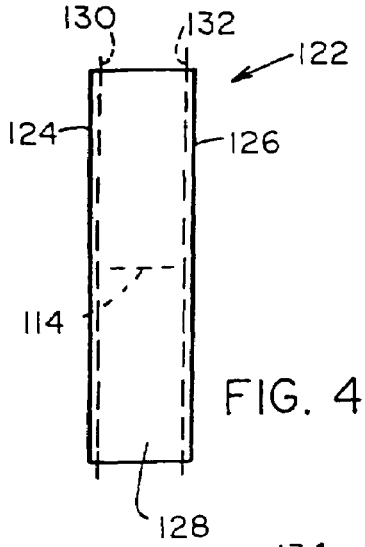
Figure 4B:
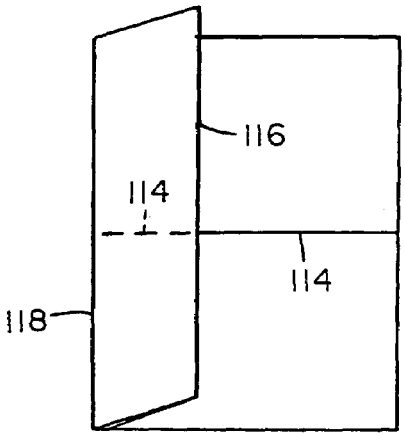
Figure 4E:
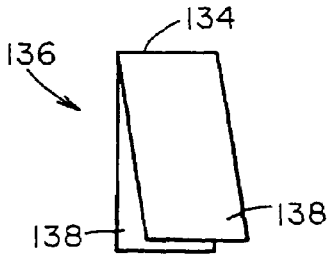
Figure 4F:
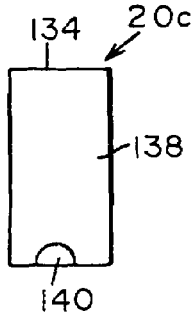
Figure 4G:
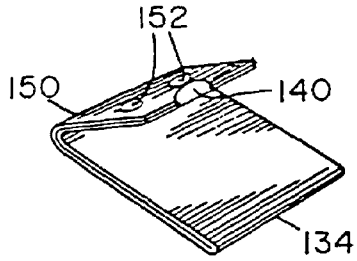
Figure 4C:
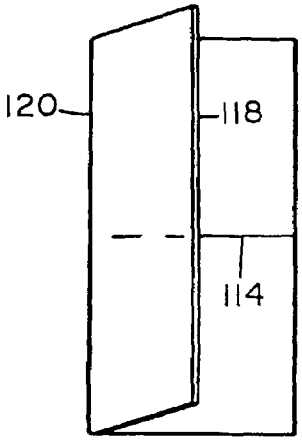

Referring to FIGS. 4B and 4C, a number of additional folds 118, 120 are made in a direction parallel to the first fold 116 and perpendicular to the adhesive 114 to result in an article 122 shown in FIG. 4D. The article 122 has a first side 124 and a second side 126 both of which are parallel to its length and each of which is composed of a plurality of folds which are integral with and which join together a plurality of sheet panels 128, each of which is bonded to at least one other sheet panel 128 via the adhesive 114. A pair of cuts or slits are then made in the article 122 along a pair of dotted lines 130, 132 in order to remove the folds disposed along the sides 124, 126 of the article 122 and cause the sheet panels 128 to become separated so that the sheet panels 128 can be moved relative to each other like the pages of a book.

Referring to FIG. 4E, the article 122 of FIG. 4D is then folded at a fold 134 that is coincident with the adhesive 114 to form an article 136 having a folded or bound edge consisting of the fold 134 and a plurality of pages or sheets 138 joined together at the bound edge 134. Referring to FIG. 4F, a closure member 140, such as a circularly shaped piece of adhesive-backed paper, may be applied to the ends of the sheets 138 opposite the bound edge 134 to form the booklet 20*c*.

Figure 4H:
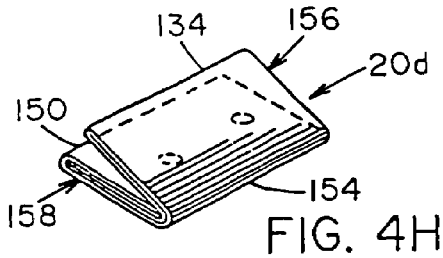

The booklet 20*c* may alternatively be provided as a folded booklet. Referring to FIG. 4G, the booklet 20*c* may be converted into a folded booklet 20*d* (FIG. 4H) by making a first fold 150 in the booklet 20*c* in a direction parallel to the bound edge 134 and by applying an adhesive 152, as shown in FIG. 4G, and then by making a second fold 154 in a direction parallel to the fold 150, as shown in FIG. 4H, so that an upper portion 156 composed of a plurality of sheets 138 is bonded to a lower portion 158 composed of a plurality of sheets 138 to form the folded booklet 20*d* having no exterior unfolded sheet edges that lie in a direction parallel to the fold 154.

While several methods of forming booklets are described above, it should be understood that other methods of forming booklets could be utilized, such as those disclosed in U.S. Pat. No. 6,273,411 to Joseph Vijuk, which is incorporated by reference herein.

Outsert and Composite Informational Item Forming Machine

Figure 5:
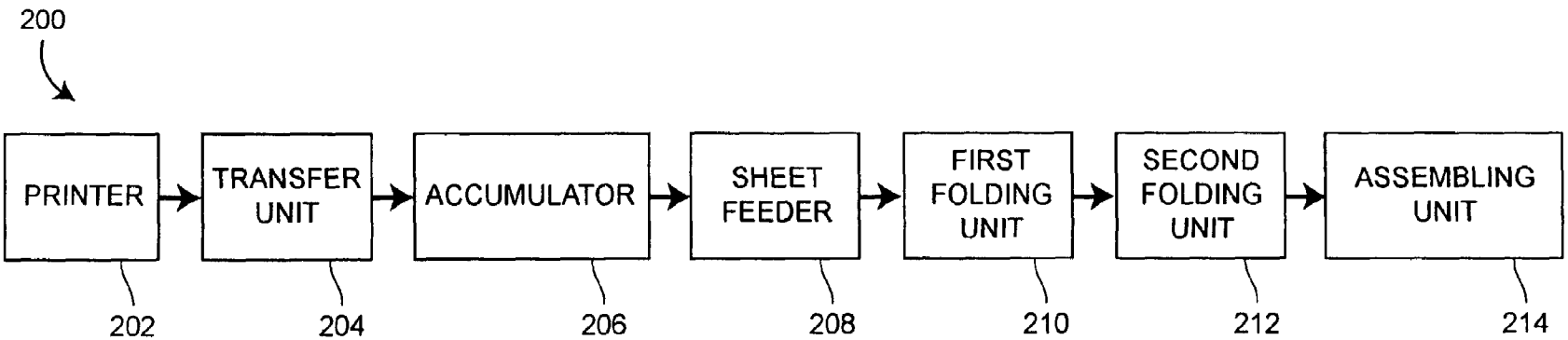
FIG. 5 is an overall block diagram of an outsert forming and bonding apparatus.

FIG. 5 is a block diagram of an embodiment of an outsert and composite informational item forming apparatus 200 that could be used to perform the outsert-forming methods described above. Referring to FIG. 5, the apparatus 200 may include a printer 202, which may be in the form of a web printer that prints textual subject matter on a paper web (not shown) provided to the printer 202 and cuts the paper web into individual sheets after it is printed. The printer 202, which may also make one or more folds in the individual sheets, produces a stream of printed sheets which may be provided to a sheet transfer unit 204. The stream of sheets may be in the form of a shingled stream, in which case the sheets are overlapping each other in a conventional manner. Each of the sheets in the stream may be unfolded, or may have one or more folds formed therein.

The transfer unit 204 may act to transfer the sheets to an accumulator station 206, at which the sheets may temporarily accumulate in a stack of sheets, before being provided by an automatic sheet feeder 208 to a first folding unit 210 that may make a plurality of folds in a first direction. The accumulator station 206 may be designed to accumulate sheets due to differences in the sheet processing capacity between the printer 202 and the first folding unit 210. The folded articles produced by the first folding unit 210 are automatically conveyed to a second folding unit 212 that may make a plurality of folds in a second direction perpendicular to the first direction to produce outserts. The outserts formed by the second folding unit 212 are automatically conveyed to an assembling unit 214. The assembling unit 214 bonds an outsert from the second folding unit 212 with a second informational item provided by an item feeder 215 to form a composite informational item such as items 10/10*a* shown in FIGS. 1A–1D.

Transfer Unit 204

Figure 7:
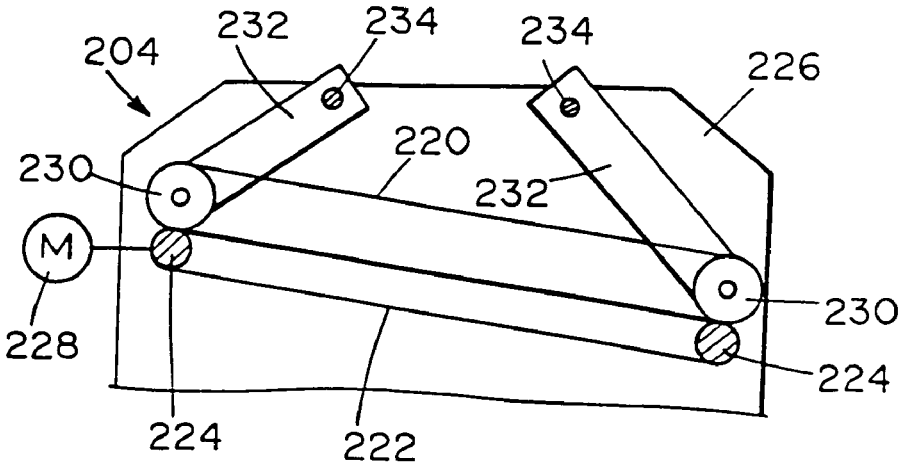
FIG. 7 is a side view of the transfer unit shown schematically in FIG. 5.

FIG. 7 is a side view of a portion of the sheet transfer unit 204 shown schematically in FIG. 5. Referring to FIG. 7, the transfer unit 204 may have a plurality of upper conveyor belts 220 and lower conveyor belts 222 between which the stream of sheets from the printer 202 passes. The lower belts 222, which may be in the form of flat belts composed of fabric having a non-slip coating, are supported by a plurality of rotatable metal rods 224 supported by a pair of frame members 226 (only one of which is shown), at least one of the rods 224 being rotatably driven by a motor shown schematically at 228.

The upper belts 220, which may be composed of rubber and which may have a circular cross section, may be supported by a plurality of rollers 230, each of which may be rotatably supported by a respective pivot arm 232 connected to one of a pair of pivot rods 234 supported between the frame members 226. The upper belts 220 may be sized so that, when they are placed onto the rollers 230, the tension of the upper belts 220 forces the pivot arms 232 downwards so that the upper belts 220 and the lower belts 222 make sufficiently firm contact with the stream of sheets to ensure that the sheets do not move relative to one another as they are transferred from the printer 202 to the accumulator station 206 by the transfer unit 204.

Accumulator Station 206

Figure 8A:
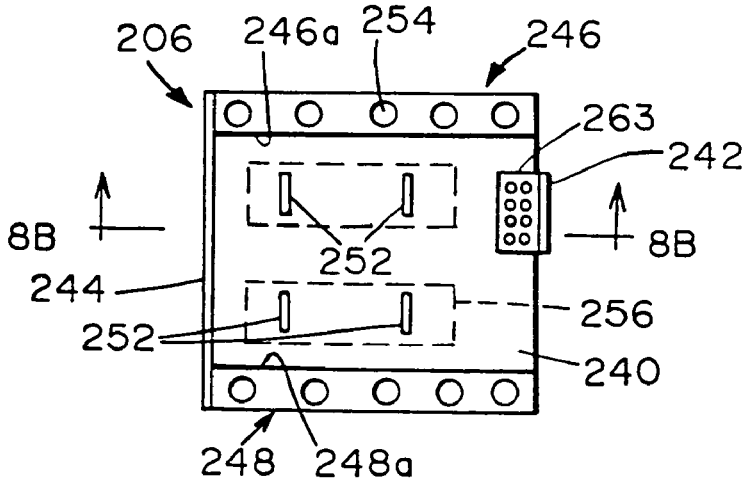
FIG. 8A is a top view of the accumulator station shown schematically in FIG. 5.
Figure 8B:
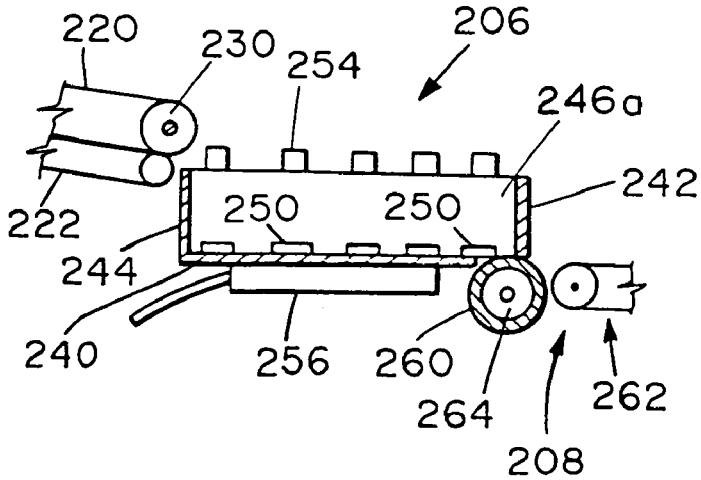
FIG. 8B is a cross-sectional side view of the accumulator station taken along lines 8B–8B of FIG. 8A.

FIGS. 8A and 8B illustrate the basic structure of one embodiment of the accumulator station 206 shown schematically in FIG. 5. Referring to FIGS. 8A and 8B, the accumulator station 206 has a flat base plate 240, a front plate 242, a rear wall 244, and a pair of elongate hexahedral side members 246, 248 each having a respective inner side surface 246*a*, 248*a*. As shown in FIG. 8B, the upper and lower conveyor belts 220, 222 of the transfer unit 204 are positioned so as to deposit sheets into the hexahedral space defined by the base plate 240, the front plate 242, the rear wall 244, and the side surfaces 246*a*, 248*a*.

Pressurized air is forced against the lower portion of the stack of sheets in the accumulator station 206 in a conventional manner to slightly levitate the lowermost sheets to reduce the coefficient of friction between the lowermost sheet in the stack and the base plate 240 and to provide slight physical separation between the lowermost sheets in the stack. The pressurized air is provided by a number of apertures 250 formed in each of the inner side surfaces 246*a*, 248*a* and a number of apertures 252 formed in the base plate 240.

The side members 246, 248, which act as pneumatic pressure manifolds, have a hollow interior which is divided into a number of individual pressure compartments, each of which is pneumatically coupled to a source of pressurized air (not shown) and to a respective one of the apertures 250 in the side surfaces 246*a*, 248*a*. The pressure of the air provided through each aperture 250 may be varied by a respective regulator knob 254 associated with each of the pressure compartments by an internal valve structure shown and described in U.S. Pat. No. 4,616,815 to Michael Vijuk, the disclosure of which is incorporated herein by reference.

Pressurized air may be provided to the apertures 252 formed in the base plate 240 via one or more pressure manifolds 256 disposed beneath the base plate 240. Pressurized air may also be provided through a number of apertures (not shown) formed in the rear wall 244. The particular design of the accumulator station 206 described above is not considered important to the invention, and other designs could be used. Sheet transfer units, accumulator stations, and automatic folding machines of the type described above are commercially available from Vijuk Equipment Co. of Elmhurst, Ill.

Sheet Feeder 208

Figure 9A:
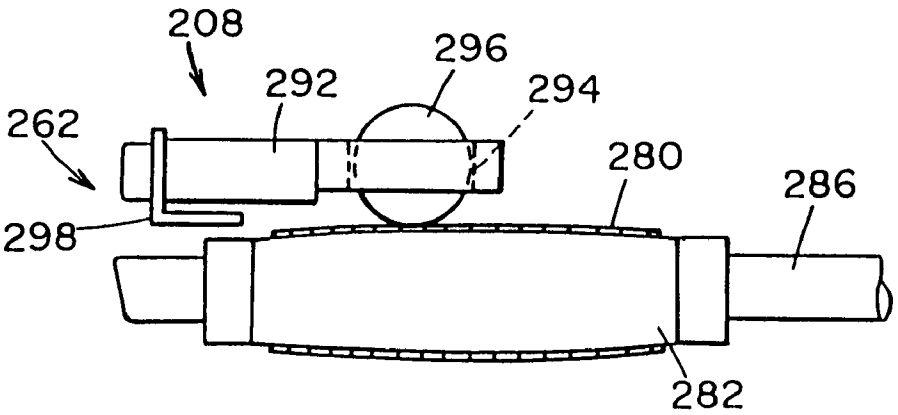
FIG. 9A is a side view of a portion of the sheet feeder shown schematically in FIG. 5.
Figure 9B:
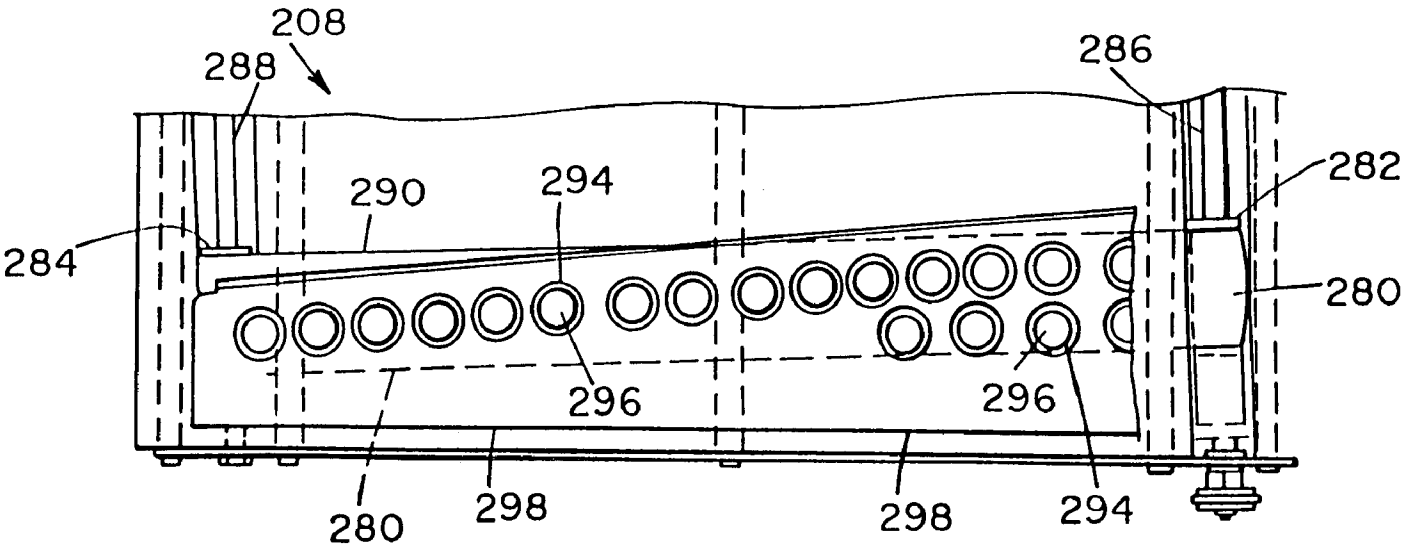
FIG. 9B is a top view of a portion of the sheet feeder of FIG. 9A.

FIGS. 8B, 9A and 9B illustrate the sheet feeder 208 shown schematically in FIG. 5. Referring to FIG. 8B, the sheet feeder 208 has a first part in the form of a vacuum drum or roll 260 and a second part in the form of a conveyor 262; The vacuum roll 260, which is controlled to periodically remove the lowermost sheet from the bottom of the stack of sheets, may be provided in the form of a hollow cylindrical drum having a plurality of holes formed in its cylindrical outer surface and is positioned directly beneath a rectangular aperture 263 formed in the base plate 240. The vacuum roll 260 has a hollow interior portion 264 in which a reduced or suction pressure may be selectively provided. To that end, the interior of the vacuum roll 260 is pneumatically coupled to a vacuum pump (not shown) via a pneumatic line (not shown) and a pneumatic valve (not shown) that is adapted to selectively open and close the pneumatic line.

FIGS. 9A and 9B illustrate the structure of the conveyor 262 shown schematically in FIG. 8B. Referring to FIGS. 9A and 9B, the conveyor 262 has a conveyor belt 280 driven by a pair of spaced rollers 282, 284 each of which is rotatably driven by a respective drive rod 286, 288. The conveyor 262 also includes a sheet alignment mechanism 290 positioned directly over the conveyor belt 280. The alignment mechanism 290 includes a retainer arm 292 having a plurality of cylindrical bores 294 formed therein, a respective metal ball 296 disposed within each of the bores 294, and an L-shaped side guide 298 connected to the retainer arm 292.

Sheets from the accumulator station 206 are periodically and individually fed by the vacuum roll 260 to the conveyor 262 so that they pass between the bottom of the metal balls 296 and the top of the conveyor belt 280. The weight of the metal balls 296 resting on top of the sheets maintains the alignment of the sheets relative to the conveyor belt 280. As shown in FIG. 9B, the side guide 298 is angled slightly relative to the conveyor belt 280. Consequently, as the sheets pass through the conveyor 262 (from right to left in FIG.

9B), the side edges of the sheets are gradually moved against the edge of the side guide 298, which movement causes the side edges of the sheets to become justified or flush against the side guide 298 for proper alignment as the sheets enter the first folding apparatus 210.

Further details regarding the design and operation of the accumulator 206 and sheet feeder 208 are disclosed in U.S. Ser. No. 09/047,716 filed in the U.S. Patent Office on Mar. 25, 1998, which is incorporated herein by reference.

Folding Units 210, 212

Figure 10A:
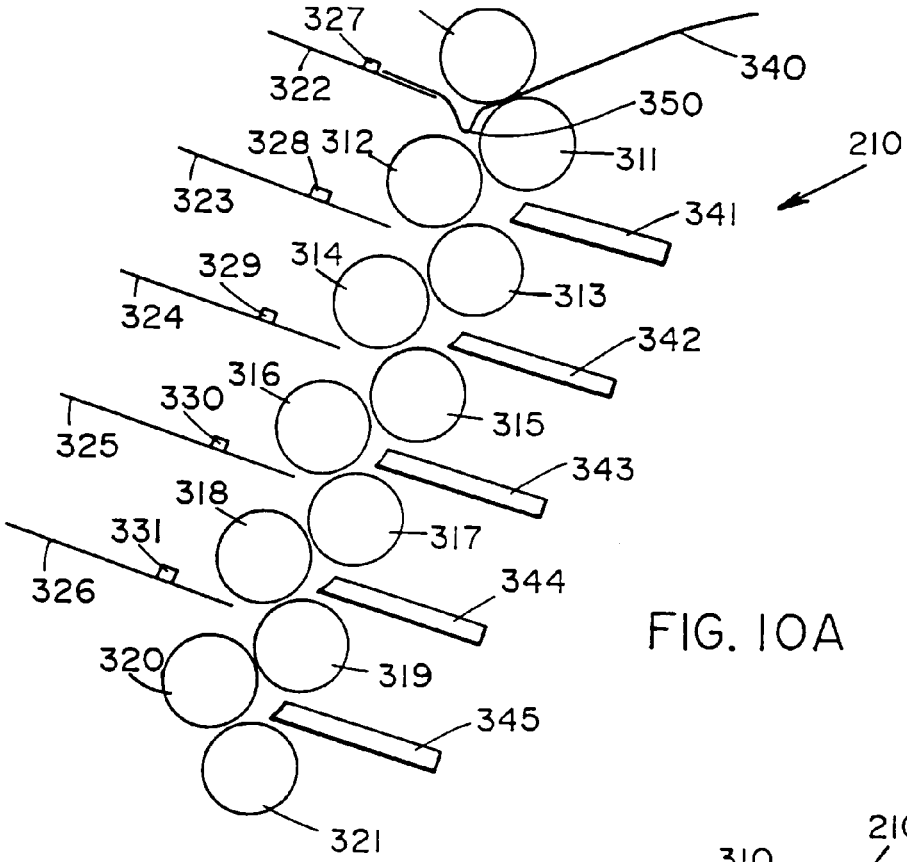
FIGS. 10A and 10B illustrate one embodiment of the first folding unit shown schematically in FIG. 5.
Figure 10B:
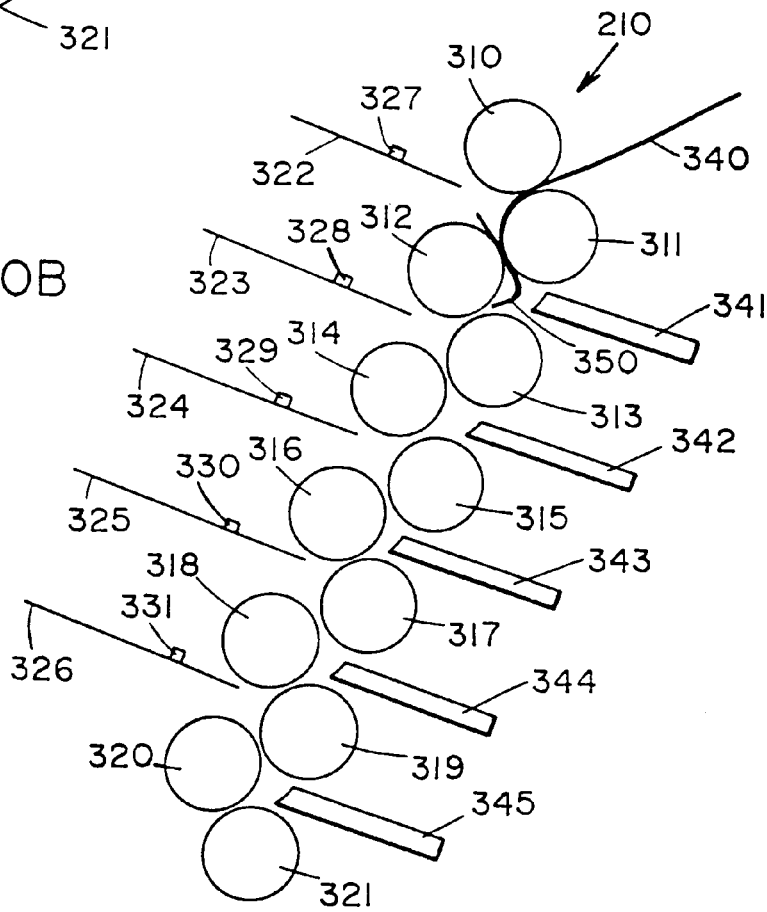

FIGS. 10A and 10B are schematic side views of an embodiment of the first folding unit 210 shown as a block in FIG. 5. The first folding unit 210 may be used to make one or more folds in an unfolded sheet of paper, all of the folds being parallel to each other. Referring to FIG. 10A, the folding unit 210 may be provided with a plurality of cylindrical folding rollers 310–321, a plurality of folding plates 322–326 each of which is provided with one of a plurality of stops 327–331 that are positioned to stop the leading edge of an article 340 passing through the folding unit 210 at desired positions, and a plurality of deflectors 341–345, each of which causes the leading edge of the article 340 passing through the folding unit 210 to be deflected towards the next pair of folding rollers.

When it first enters the first folding unit 210, the article 340 shown in FIGS. 10A and 10B may correspond to an unfolded sheet of paper, such as the sheet of paper 30 shown in FIG. 2A or the sheet of paper 70 shown in FIG. 3A. When the leading edge of the article 340 hits the stop 327, an intermediate portion of the article at a point 350 is forced downwardly towards the nip of the folding rollers 311, 312. When the point 350 passes between the folding rollers 311, 312, the article 340 is folded at the point 350 by the folding rollers 311, 312 and then deflected by the end of the deflector 341 towards the nip of the folding rollers 312, 313, as shown in FIG. 10B.

The process continues in a similar manner until all of the desired folds are made in the article 340. The folding unit 210 shown in FIGS. 10A and 10B would make five folds in the article 330. The number of folds and the positions at which they are made could be varied in a known manner by varying the number and/or position of the folding rollers 310–321, the folding plates 322–326 and the deflector plates 341–345.

Figure 11A:
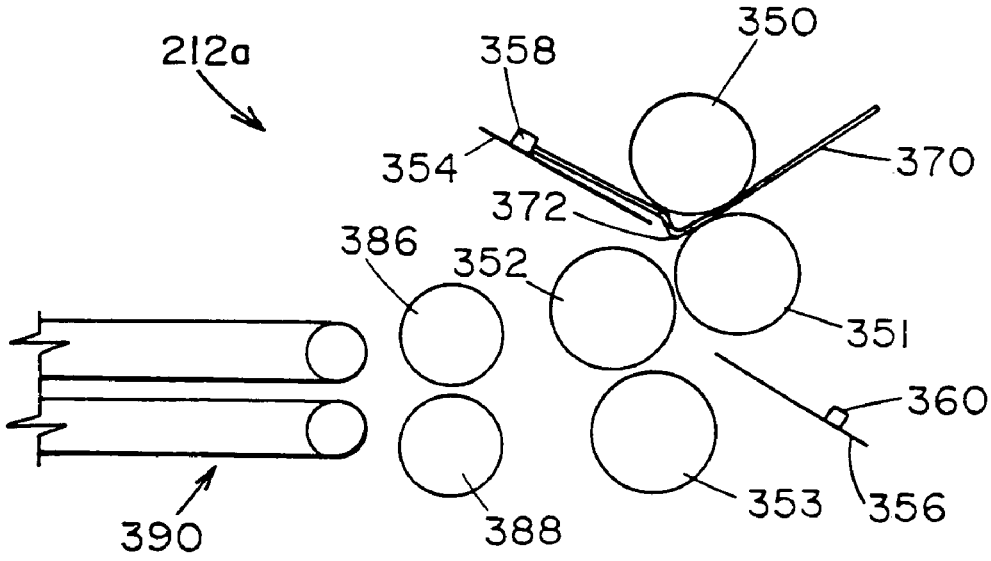
FIGS. 11A–11D illustrate a first portion of one embodiment of the second folding unit shown schematically in FIG. 5.

FIG. 11A is a side view of a first apparatus portion 212*a* of the second folding unit 212 shown schematically in FIG. 5. The second folding unit 212 may be used to make one or more folds in an article in a direction perpendicular to the direction in which one or more initial folds were made. Referring to FIG. 11A, the second folding unit 212 may be provided with a plurality of cylindrical folding rollers 350–353, a pair of folding plates 354, 356, each of which is provided with one of a pair of stops 358, 360 that are positioned to stop the leading edge of an article 370 passing through the folding unit 212 at desired positions.

Figure 11B:
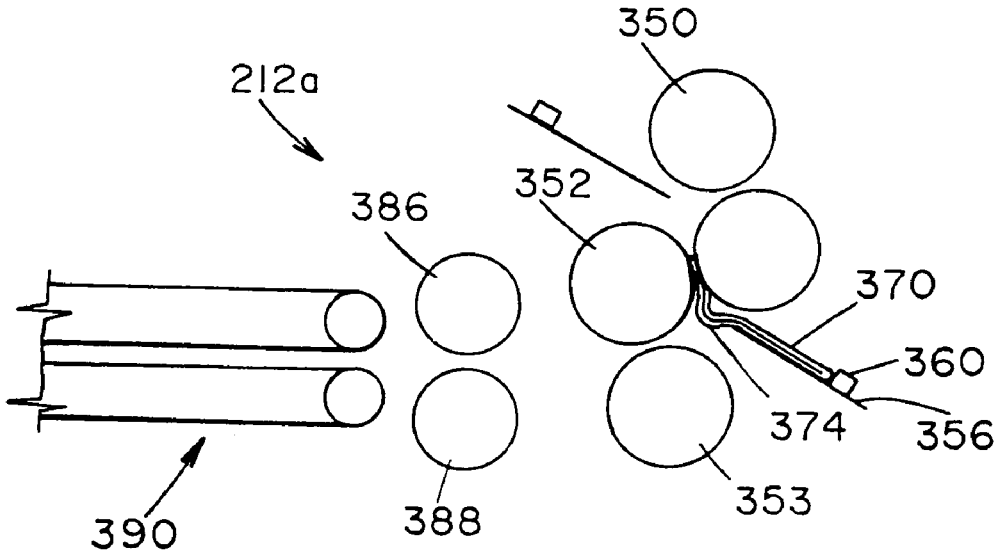
Figure 11C:
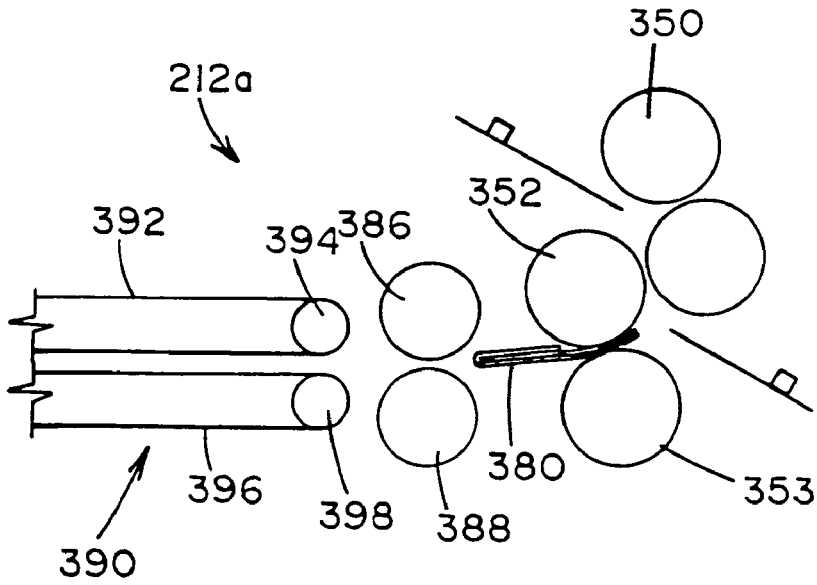

When it first enters the first folding unit 212, the article 370 shown in FIG. 11A may correspond to a folded article having a plurality of parallel folds made in a first direction, such as the folded article 40 shown in FIG. 2B or the folded article 82 shown in FIG. 3E. When the leading edge of the article 370 hits the stop 358, an intermediate portion of the article at a point 372 is forced downwardly towards the nip of the folding rollers 351, 352. When the point 372 passes between the folding rollers 351, 352, the article 370 is folded at the point 372 by the folding rollers 351, 352, and then the leading folded edge 372 of the article 370 moves along the folding plate 356 until it makes contact with the stop 360, as shown in FIG. 11B. As the rear portion of the article 370 continues to advance, an intermediate portion of the article 370 buckles at a point 374 and moves downwardly towards the nip of the folding rollers 352, 353. When the point 374 passes between the folding rollers 352, 353, it is folded by the folding rollers 352, 353, as shown in FIG. 11C. At that point, the article 370 has a leading portion 380 and a trailing portion 382, with the leading portion 380 being twice as thick as the trailing portion 382, which is shown most clearly in FIG. 11D.

Figure 11D:
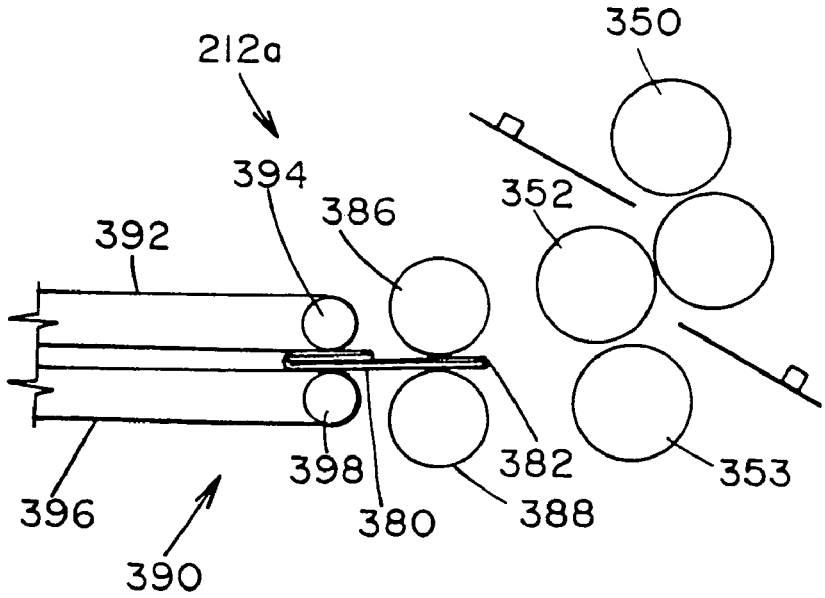

Referring to FIGS. 11C and 11D, the article 370 may be passed through a pair of cylindrical flattening rollers 386, 388 and then to a conveyor 390, which may be provided with one or more upper conveyor belts 392 supported by a plurality of cylindrical rollers 394 and one or more lower conveyor belts 396 supported by a plurality of cylindrical rollers 398.

Figure 12A:
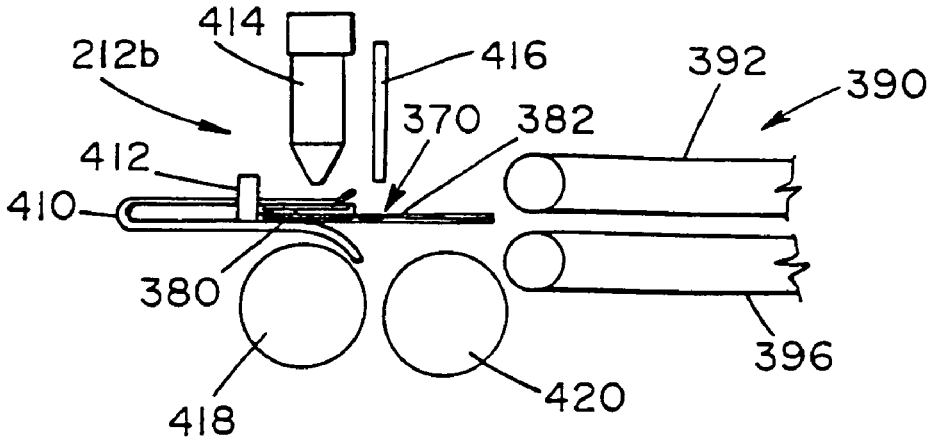
FIGS. 12A and 12B illustrate a second portion of one embodiment of the second folding unit shown schematically in FIG. 5.
Figure 12B:
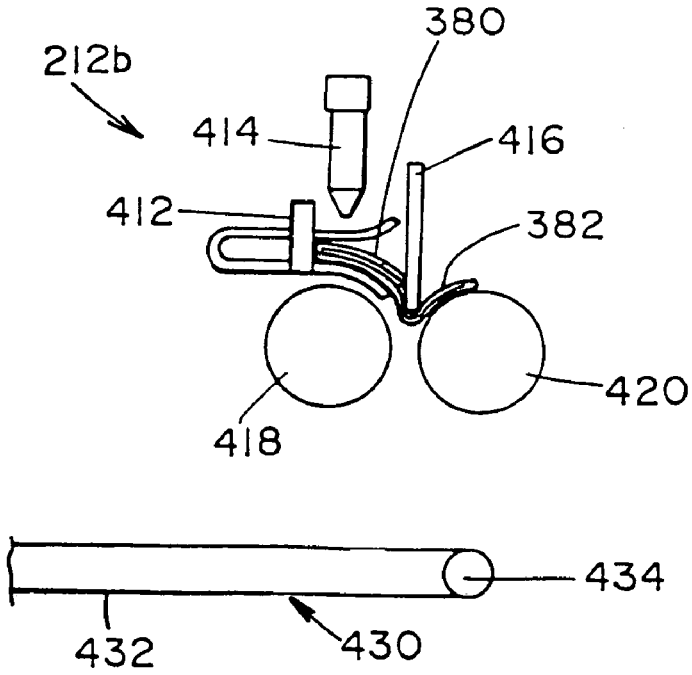

The second folding unit 212 may be provided with a section 212*b* as shown in FIGS. 12A and 12B. Referring to FIGS. 12A and 12B, the section 212*b* may be provided with guide member 410, a stop member 412 associated with the guide member 410, one or more glue applicators 414, a linearly translatable deflection or knife member 416, a pair of rotatable cylindrical folding rollers 418, 420, and a conveyor 430.

Referring to FIGS. 12A and 12B, after the folded article 370 exits the conveyor 390, the leading edge of the folded article 370 abuts against the stop member 412. With the folded article 370 in that position as shown in FIG. 12A, the bottom edge of the deflection member 416 is positioned generally in the middle of the folded article 370 at the intersection between the relatively thick leading portion 380 and the relatively thin trailing portion 382.

With the folded article 370 so positioned, one or more spots of glue may be deposited onto the upper surface of the relatively thick leading portion 380, and then the deflection member 416 may be moved downwardly so that it makes contact with an intermediate portion of the folded article 370 and so that it pushes the intermediate portion towards the nip between the folding rollers 418, 420, as shown in FIG. 12B. As the folded article 370 passes through the folding rollers 418, 420, the article 370 will be folded so that the portion 382 is folded over the portion 380, with the glue spots disposed between the two portions 380, 382 so that the resulting outsert remains in a substantially closed orientation with the portions 380, 382 adhered together.

The outsert is then automatically conveyed by the conveyor 430, which may be provided with one or more endless conveyor belts 432 and a plurality of rotatable conveyor rollers 434, to the assembling unit 214 shown schematically in FIG. 5.

Further details regarding folding units that could be used for the first and second folding units 210, 212 are described in U.S. Pat. Nos. 6,273,411, 4,616,815, 4,812,195, 4,817,931, 5,044,873 and 5,046,710, all of which are incorporated herein by reference.

Although a particular embodiment of the folding units 210, 212 is described above, numerous other embodiments and types of folding units could be utilized, and the particular type of folding units used is not considered important to the invention.

Assembling Unit 214

Figure 13:
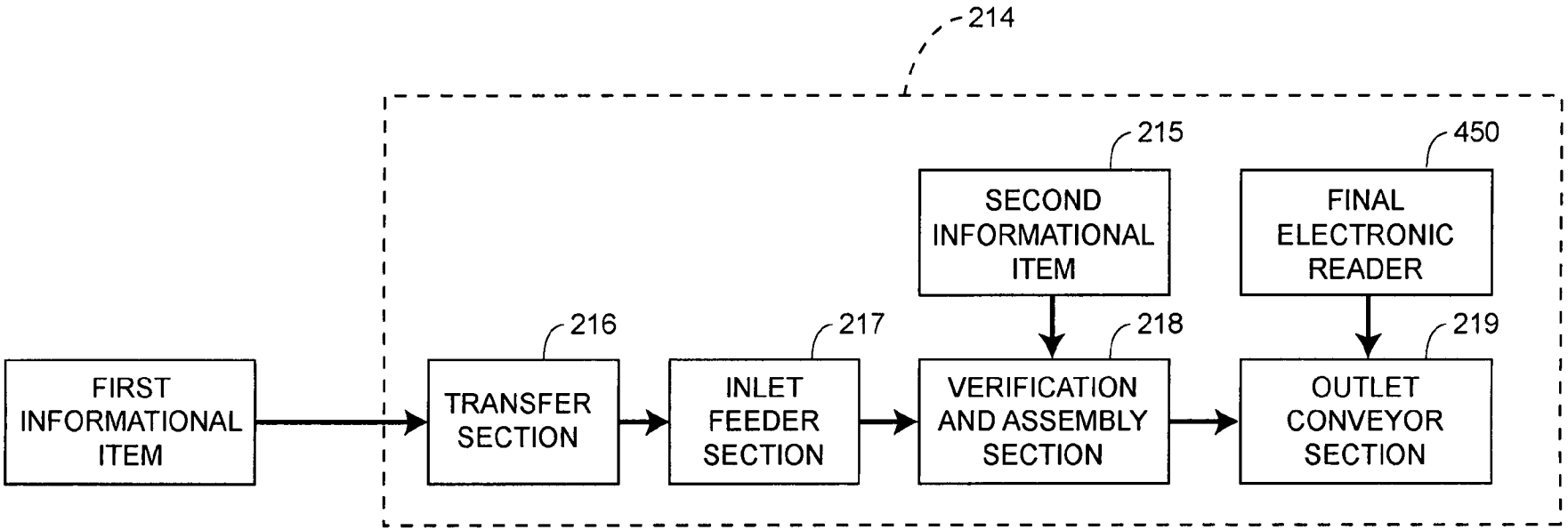
FIG. 13 is a block diagram of a composite informational item assembling unit shown schematically in FIGS. 5 and 6.

FIG. 13 is a block diagram of the composite informational item assembling unit 214. The assembling unit 214 includes a transfer section 216 for receiving a first informational item (in this embodiment, an outsert) from the conveyor 430 of the second folding unit 212. The transfer section 216 deposits the first informational item into an inlet feeder section 217, which advances the first informational item toward a verification and assembly section 218. In the verification and assembly section 218, adhesive is applied to the first informational item and a second informational item is pulled from the item feeder 215, electronically verified, and deposited on top of the first informational item to form the composite informational item. The composite informational item is then advanced to an outlet conveyor section 219, which discharges the completed composite informational item. The assembling unit 214 may include a final electronic reader 450 for electronically verifying the composite informational item.

Figure 14:
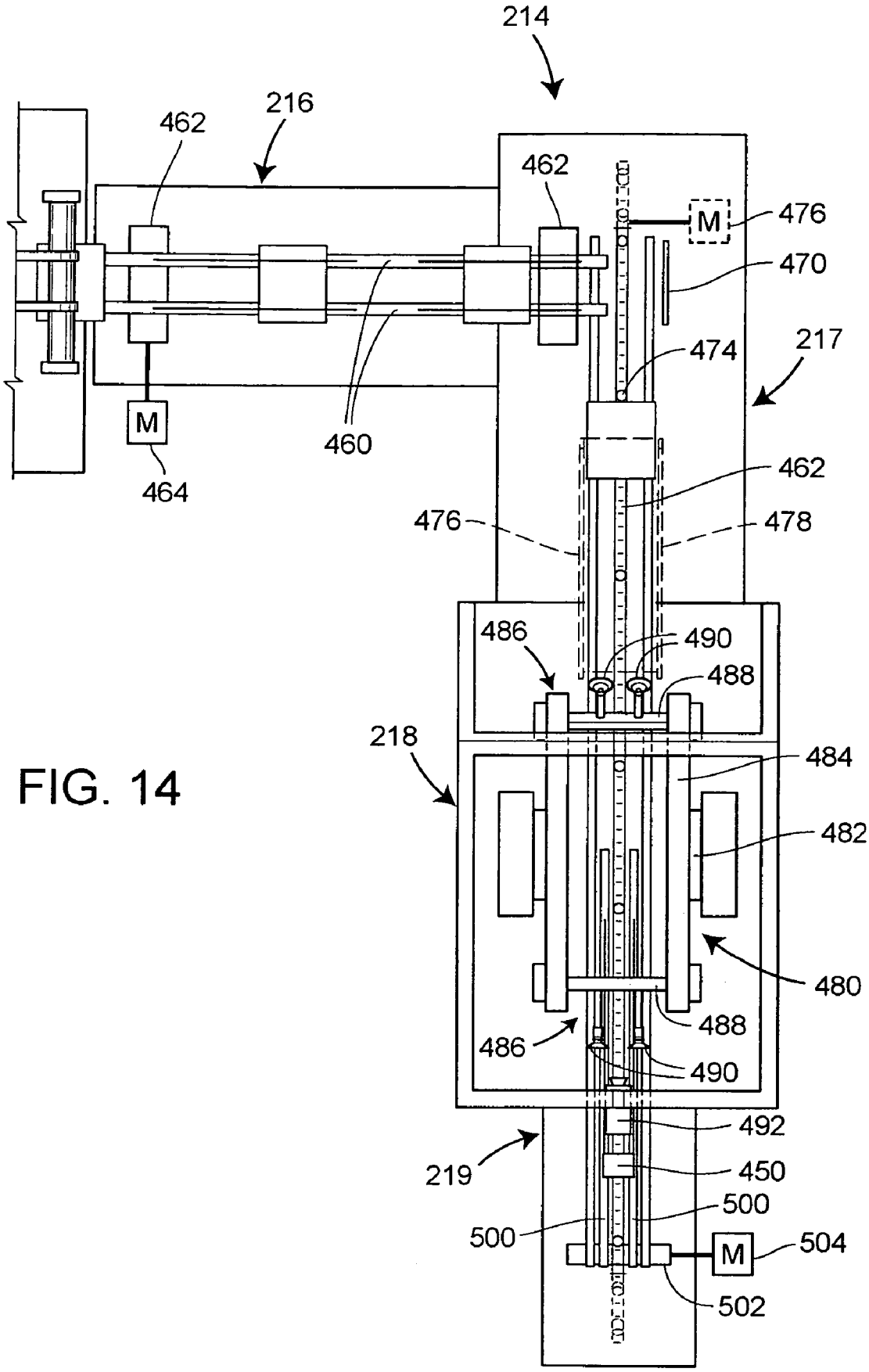
FIG. 14 is a partially schematic plan view of an assembling unit for forming a composite informational item.

As best shown in FIG. 14, the transfer section 216 may include one or more endless conveyor belts 460 and a plurality of rotatable conveyor rollers 462 for automatically conveying the formed outserts from the second folding unit 212 to the inlet feeder section 217. At least one of the conveyor rollers 462 is rotatably driven by a motor shown schematically at 464.

The inlet feeder section 217 includes a rail 470 against which the folded outsert is deposited by the transfer section 216. A chain 472 carrying spaced lugs 474 extends transversely to the transfer section 216 and extends through the verification and assembly section 218. Guides 476, 478 are positioned on opposite sides of the chain 472 so that the lug 474 advances the folded outsert toward the verification and assembly section 218. The chain 472 may be intermittently or continuously driven by a motor shown schematically at 476.

Figure 15A:
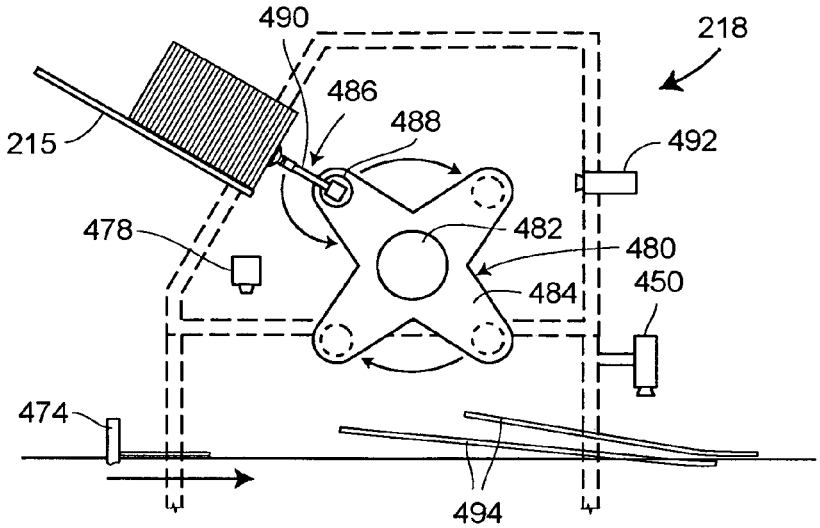
FIGS. 15A–C are partially schematic side views of a rotary head assembly portion of the assembling unit of FIG. 13 illustrating a pick-and-place operation.
Figure 15B:
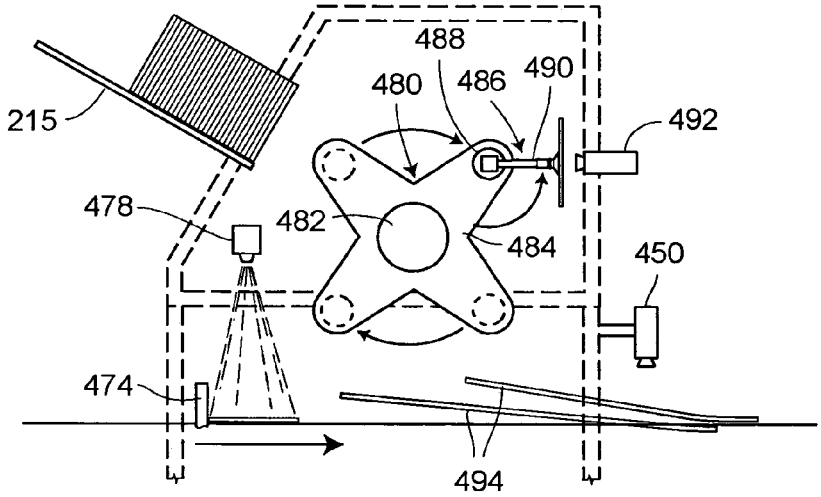
Figure 15C:
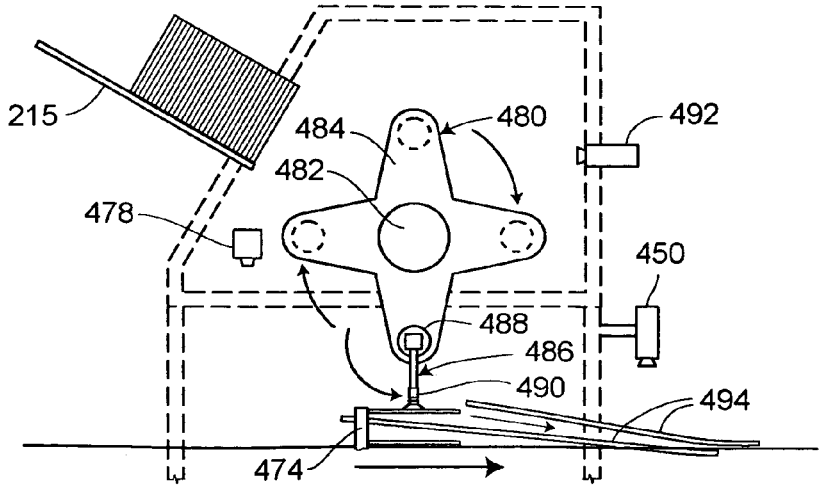

As shown in FIGS. 15A–15C, an adhesive applicator 478 is positioned above the chain 472 near an inlet end of the verification and assembly section 218. As the lug 474 advances the folded outsert into the section 218, the applicator 478 deposits adhesive onto a top panel of the outsert.

The verification and assembly section 218 may further include a transfer mechanism for automatically transferring a second informational item from the item feeder 215 to a position above the first informational item. In the illustrated embodiment, a rotary head assembly 480 is provided for picking a second informational item from the item feeder 215, electronically verifying the second informational item, and depositing the second informational item above the folded outsert. As shown in FIGS. 15A–15C, the rotary head assembly 480 includes a main shaft 482 and a frame 484 coupled to and rotating with the main shaft 482. In the embodiment shown in FIG. 14, two transfer heads 486 may be journally supported for rotation on opposite ends of the frame 484. Each transfer head 486 includes a rotatable shaft 488 that is operably coupled so that rotation of the main shaft 482 and frame in a first direction causes rotation of the transfer head shafts 488 in an opposite direction, as described in greater detail by U.S. Pat. No. 4,643,633, which is incorporated by reference herein. Each of the transfer head shafts 488 may carry a pair of engagement members 490 selectively supplied with vacuum pressure to grip and transfer second informational items from the item feeder 215.

In the embodiment illustrated in FIGS. 15A–15C, the frame 474 of the rotary head assembly may carry four transfer heads 486, wherein each transfer head may be positioned at the end of an arm extending from the center of the frame 474. While each of the transfer heads 486 may include a rotatable shaft 488 and a pair of engagement members 490 as described above, for clarity FIGS. 15A–15C have been illustrated with only a first transfer head 486 during operation. The engagement members 490 of each transfer head 486 pass through three apex positions during each rotation of the rotary head assembly 480. A first apex position of the first transfer head 486 is shown in FIG. 15A, where the engagement members 490 are positioned adjacent the second informational item feeder 215. Vacuum is supplied to the engagement members 490 of the first transfer head 486 in the first apex position to pull a second informational item from the feeder 215.

When the rotary head assembly 480 rotates to the position shown in FIG. 15B, the engagement members 490 of the first transfer head 486 are positioned at a second apex position. In this second apex position, the engagement members 490 hold the second informational item near an electronic reader, such as a bar code scanner 492, to electronically verify the second informational item.

Finally, when the rotary head assembly 480 rotates to the position shown in FIG. 15C, the engagement members 490 of the first transfer head 486 are positioned at a third apex position. In the third apex position, the engagement members 490 hold the second informational item above deposit rails 494. At this point, vacuum to the engagement members 490 is interrupted, so that the second informational item falls onto and is supported above the chain by the deposit rails 494.

While FIGS. 15A–C illustrate only a single transfer head 486 operating through the three apex positions, any additional transfer heads 486 carried by the frame 474 may pass through each of the positions described above, thereby to increase the rate at which composite informational items are assembled. Furthermore, while a rotary head assembly 480 is illustrated herein, other types of transfer mechanisms may be used in place of the rotary head assembly 480 without departing from the scope of the present invention.

To complete assembly of the composite informational item, the outsert with adhesive is advanced into contact with the second informational item supported on the deposit rails 494. In the illustrated embodiment, the deposit rails 494 slope downwardly toward the outlet end. The lug 474 is sufficiently long so that it engages the outsert but also the second informational item deposited on the rails 494. Accordingly, the lug 474 will simultaneously advance both the outsert and the second informational item. As the second informational item is advanced down the sloping portion of the rails 494, it will come into contact with the adhesive on the outsert. The adhesive may be a hot melt glue that instantly bonds with the second informational item, thereby to form the composite informational item. Additionally, a pressing mechanism may be provided for ensuring that the outsert and second informational item are sufficiently bonded together.

The rotating frame 484 may be rotated by a belt that is also driven by the motor 476. The chain 472 and belt may be operatively coupled so that timing between the two is maintained during operation.

The lug 474 advances the composite informational item to the outlet conveyor section 219, which may be constructed similar to the transfer section 216. Accordingly, the outlet conveyor section 219 may include one or more endless conveyor belts 500 and a plurality of rotatable conveyor rollers 502 for automatically conveying the composite informational item from the verification and assembly section 218 to a discharge area. At least one of the conveyor rollers 502 is rotatably driven by a motor, such as motor 504.

A final electronic reader 450 may be provided in the outlet conveyor section 219 or downstream portion of the verification and assembly section 218 for electronically verifying the assembled composite informational item. As illustrated in FIG. 14, the final electronic reader 450, such as a bar code scanner, is positioned above the conveyor belts 500. The outsert and second informational item may be configured so that a portion of each item bearing the associated identifier is viewable from above, as shown in FIG. 1A. As a result, the second bar code scanner 450 may electronically verify both the outsert and the second informational item after assembly into the composite informational item.

While the above embodiments are described as adhering a first informational item and a second informational item to form a composite informational item, the method and apparatus may be modified to form a composite informational item having more than two individual informational items. For example, a second verification and assembly section 218 may be added downstream of the outlet conveyor section 219 for verifying and adhering a third informational item to first and second informational items. Furthermore, while the assembling unit 214 illustrated in FIG. 14 is oriented to advance the first informational item at a ninety degree right turn with respect to the second folding unit 212, it will be appreciated that the assembling unit 214 may be oriented so that the first informational item is advanced parallel to, at a ninety degree left turn, or at any other angle with respect to the folding unit 212.

Overall Operation of Outsert and Composite Informational Item Forming Machine In the overall operation of the outsert and composite informational item forming machine 200 shown in FIG. 5, the printer 202 may continuously generate sheets of material having printed information disposed thereon, such as the sheet 30 shown in FIG. 2A or the sheet 70 shown in FIG. 3A. The printed sheets may then be transferred by the transfer unit 204 from the printer 202 to the accumulator 206, and then fed by the sheet feeder 208 to the first folding unit 210.

The first folding unit 210 makes one or more folds in each of the sheets, with each fold being made parallel to a first direction. The folds may correspond to the folds described above in connection with FIG. 2B; the folds may correspond to those shown in FIGS. 3A–3E; or they may correspond to some other series of folds.

The folded articles generated by the first folding unit 210 are then supplied to the second folding unit 212, which makes one or more folds in a direction perpendicular to the direction in which the folds were made by the first folding unit 210. The second folding unit 212 may make a plurality of folds like the ones described above in connection with FIGS. 2C–2E; the second folding unit 212 may make a plurality of folds like the ones described above in connection with FIGS. 3F–3I; or the second folding unit 212 may make some other combination of folds.

After being formed into informational items by the second folding unit 212, the informational items are automatically conveyed to the assembling unit 214 where they are bonded with a second informational item to form the composite informational item 10/10*a* as described above in detail in connection with FIGS. 1A–C, 13, 14, and 15.

Booklet and Composite Informational Item Forming Machine

Figure 6:
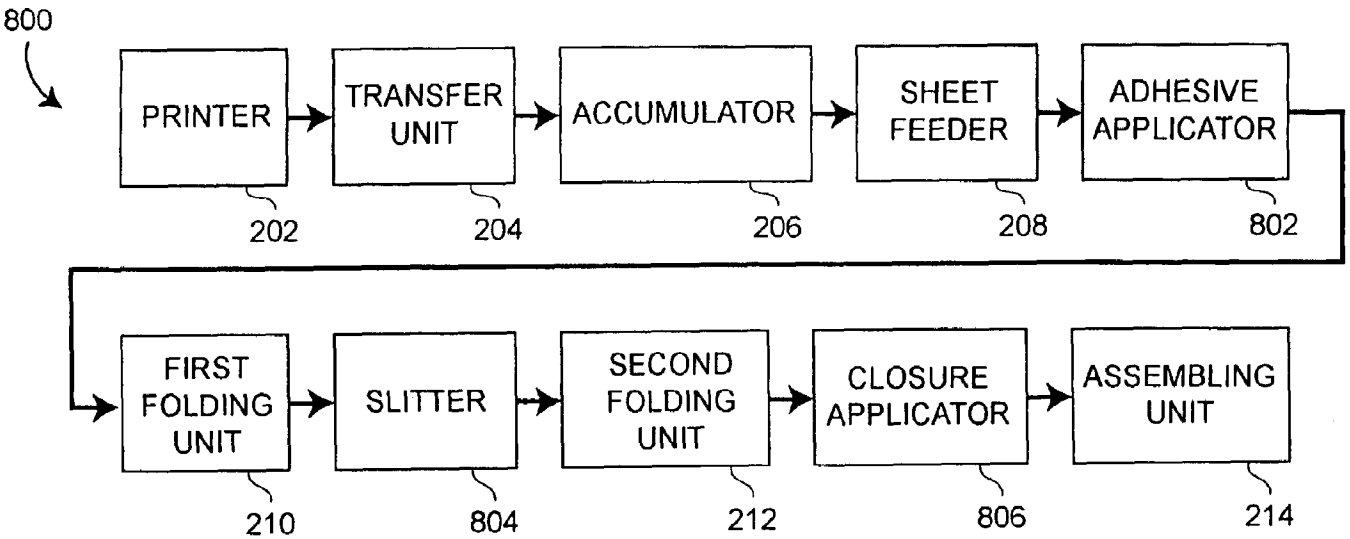
FIG. 6 is an overall block diagram of a booklet forming and bonding apparatus.

FIG. 6 is a block diagram of an embodiment of a booklet and composite informational item forming apparatus 800 that could be used to perform the booklet-forming and composite informational item methods described above. Referring to FIG. 6, the apparatus 800 may be provided with a number of the same or similar components described above in connection with the outsert and composite informational item forming apparatus 200, including the printer 202, the transfer unit 204, the accumulator 206, the sheet feeder 208, the first folding unit 210, the second folding unit 212, and assembling unit 214, the operation of which may be generally the same as described above.

The booklet and composite informational item forming apparatus 800 may be provided with three additional components, including an adhesive applicator 802, a cutter or slitter 804 and a closure applicator 806. The adhesive applicator 802 may be used to apply a line of adhesive or plurality of adhesive portions along a line to a sheet of material before it is fed to the first folding unit 210, as described above in connection with FIGS. 4A–4E. The slitter 804 may be used to slit or cut off the folded side edges 124, 126 of the article 122, as described above in connection with FIG. 4D. The closure applicator 806 may be used to apply the closure member 140 to form a closed booklet, as described above in connection with FIG. 4F. Further details regarding the components 802, 804, 806 are disclosed in U.S. Pat. No. 6,273,411, which is incorporated by reference herein. The particular structure of those components is not considered important to the invention, and other designs could be used.

While the specific embodiments described above use an outsert or a booklet as the first informational item, it will be appreciated that any substrate on which information may be provided may serve as the first informational item. Similarly, the second informational item may be an outsert, an insert, a booklet, or any other substrate on which information may be provided.

Since each of the structures and acts described above is only exemplary and may be used in various embodiments of the invention, numerous structures and acts described above are intended to be optional. Structures and acts described above can be omitted, and other structures and acts may be substituted therefor.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of forming a composite informational item having information regarding a pharmaceutical product printed thereon, said composite informational item comprising a first bidirectionally folded outsert releasably bonded to a second bidirectionally folded outsert, each of said first and second bidirectionally folded outserts having information regarding a pharmaceutical product printed thereon, each of said first and second bidirectionally folded outserts having a plurality of folds in two perpendicular directions, said method comprising:

(a) forming said first bidirectionally folded outsert via a method comprising:

(a1) folding a first sheet of paper having information regarding a pharmaceutical product printed thereon by making a plurality of folds in said first sheet of paper to form a first folded article, said folds in said first sheet of paper being parallel to each other and parallel to a first direction, said plurality of folds in said first sheet of paper being made by a folding apparatus comprising a plurality of pairs of folding rollers;

(a2) folding said first folded article by making a plurality of folds in said first folded article to form a second folded article, said folds in said first folded article being parallel to a second direction, said second direction being perpendicular to said first direction, said plurality of folds in said first folded article being made by a folding apparatus comprising a plurality of pairs of folding rollers;

(a3) depositing an adhesive on a portion of said second folded article; and (a4) folding said second folded article by making a fold in said second folded article to form said first bidirectionally folded outsert, said fold in said second folded article being parallel to said second direction and being made so that said adhesive holds said first bidirectionally folded outsert in a substantially closed position, said fold in said second folded article being made with a knife-type folding apparatus comprising a pair of folding rollers and a movable knife member;

(b) automatically conveying said first bidirectionally folded outsert from a location in a first feed apparatus to a bonding location;

(c) providing a plurality of said second bidirectionally folded outserts in a second feed apparatus different than said first feed apparatus, each of said second bidirectionally folded outserts having a plurality of folds in a first direction and a plurality of folds in a second direction perpendicular to said first direction;

(d) automatically depositing a releasable adhesive on a face of one of said bidirectionally folded outserts;

(e) automatically conveying one of said second bidirectionally folded outserts from a location in said second feed apparatus to said bonding location; and (f) causing a face of said first bidirectionally folded outsert to make contact with a face of said second bidirectionally folded outsert as the first bidirectionally folded outsert is being conveyed through the bonding location so that said first bidirectionally folded outsert and said one second bidirectionally folded outsert are releasably bonded together via said releasable adhesive applied to said face of one of said bidirectionally folded outserts.

2. A method as defined in claim 1 wherein each of said plurality of second bidirectionally folded outserts includes an electronically readable identifier, said method further comprising verifying said electronically readable identifier as each of said second bidirectionally folded outserts is conveyed to said bonding position.

3. A method as defined in claim 1 wherein at least one of said first and second bidirectionally folded outserts includes an electronically readable identifier, said method further comprising verifying said electronically readable identifier after said first and second bidirectionally folded outserts are adhesively bonded together.

4. A method as defined in claim 1 wherein deposit rails disposed at the bonding location slope downwardly toward an outlet end of the bonding location, wherein automatically conveying said first bidirectionally folded outsert comprises conveying the first bidirectionally folded outsert under the deposit rails, wherein automatically conveying one of said second bidirectionally folded outserts comprises disposing said second bidirectionally folded outsert on top of the deposit rails, and wherein causing contact of said first and second bidirectionally folded outserts comprises advancing said second bidirectionally folded outsert down a sloping portion of the deposit rails and into contact with said first bidirectionally folded outsert as said first bidirectionally folded outsert is being conveyed under the deposit rails.

5. A method as defined in claim 4 wherein automatically conveying said first bidirectionally folded outsert comprises engaging the first bidirectionally folded outsert with a lug driven toward the bonding location.

6. A method as defined in claim 5 comprising engaging said second bidirectionally folded outsert with the lug to advance the second bidirectionally folded outsert down said sloping portion of the deposit rails as said first bidirectionally folded outsert is being conveyed under the deposit rails.

7. A method as defined in claim 1 wherein automatically conveying one of said second bidirectionally folded outserts comprises:

engaging a surface of one of said second bidirectionally folded outserts disposed in a location in said second feed apparatus with a transfer device;

automatically conveying said second bidirectionally folded outsert from said location in said second feed apparatus to said bonding location by moving said transfer device; and disengaging said transfer device from said surface of said second bidirectionally folded outsert after said second bidirectionally folded outsert is conveyed to said bonding location.

8. A method of forming a composite informational item having information regarding a pharmaceutical product printed thereon, said composite informational item comprising a first bidirectionally folded outsert releasably bonded to a second bidirectionally folded outsert, each of said first and second bidirectionally folded outserts having information regarding a pharmaceutical product printed thereon, each of said first and second bidirectionally folded outserts having a plurality of folds in two perpendicular directions, said method comprising:

(a) forming said first bidirectionally folded outsert via a method comprising:

(a1) folding a first sheet of paper having information regarding a pharmaceutical product printed thereon by making a plurality of folds in said first sheet of paper to form a first folded article, said folds in said first sheet of paper being parallel to each other and parallel to a first direction, said plurality of folds in said first sheet of paper being made by a folding apparatus comprising a plurality of pairs of folding rollers;

(a2) folding said first folded article by making a plurality of folds in said first folded article to form a second folded article, said folds in said first folded article being parallel to a second direction, said second direction being perpendicular to said first direction, said plurality of folds in said first folded article being made by a folding apparatus comprising a plurality of pairs of folding rollers;

(a3) depositing an adhesive on a portion of said second folded article; and (a4) folding said second folded article by making a fold in said second folded article to form said first bidirectionally folded outsert, said fold in said second folded article being parallel to said second direction and being made so that said adhesive holds said first bidirectionally folded outsert in a substantially closed position, said fold in said second folded article being made with a knife-type folding apparatus comprising a pair of folding rollers and a movable knife member;

(b) automatically conveying said first bidirectionally folded outsert from a location in a first feed apparatus to a bonding location;

(c) providing a plurality of said second bidirectionally folded outserts in a second feed apparatus different than said first feed apparatus, each of said second bidirectionally folded outserts having a plurality of folds in a first direction and a plurality of folds in a second direction perpendicular to said first direction;

(d) automatically depositing a releasable adhesive on a face of one of said bidirectionally folded outserts;

(e) engaging a surface of one of said second bidirectionally folded outserts disposed in a location in said second feed apparatus with a transfer device;

(f) automatically conveying said second bidirectionally folded outsert from said location in said second feed apparatus to said bonding location by moving said transfer device;

(g) disengaging said transfer device from said surface of said second bidirectionally folded outsert after said second bidirectionally folded outsert is conveyed to said bonding location; and (h) causing a face of said first bidirectionally folded outsert to make contact with a face of said second bidirectionally folded outsert so that said first bidirectionally folded outsert and said one second bidirectionally folded outsert are releasably bonded together via said releasable adhesive applied to said face of one of said bidirectionally folded outserts.

9. A method as defined in claim 8 wherein moving said transfer device comprises moving said transfer device through a rotational path between said location in said second feed apparatus and said bonding location.

10. A method as defined in claim 8 wherein said transfer device is a vacuum head, wherein engaging said surface comprises applying a vacuum at said vacuum head to attach said vacuum head to said surface, and wherein disengaging said surface comprises removing said vacuum at said vacuum head to release said vacuum head from said surface.

11. A method as defined in claim 8 wherein said face of said first bidirectionally folded outsert makes contact with said face of said second bidirectionally folded outsert as the first bidirectionally folded outsert is being conveyed through the bonding location.

* * * * *